US006321461B1

(12) United States Patent
Ogasahara

(10) Patent No.: US 6,321,461 B1
(45) Date of Patent: Nov. 27, 2001

(54) DRYING APPARATUS USING HIGH PRESSURE GAS

(75) Inventor: Minoru Ogasahara, House-Rosen-Garden No. 201, 21-1 Hirakawa Chayaura, Joyo-shi, Kyoto (JP)

(73) Assignee: Minoru Ogasahara, Joyo (JP)

( * ) Notice: Subject to any disclaimer, the term of this patent is extended or adjusted under 35 U.S.C. 154(b) by 0 days.

(21) Appl. No.: 09/544,500

(22) Filed: Apr. 7, 2000

(51) Int. Cl.[7] ..... F26B 17/10

(52) U.S. Cl. ..... 34/169; 34/168; 34/84; 34/585

(58) Field of Search ..... 34/83, 84, 168, 34/169, 181, 582, 585, 364, 516

(56) References Cited

U.S. PATENT DOCUMENTS 4,441,261 * 4/1984 Beckmann ..... 34/169
4,509,272 * 4/1985 Graff ..... 34/169
5,487,225 * 1/1996 Downie ..... 34/473

FOREIGN PATENT DOCUMENTS 2000-18824 1/2000 (JP) .

* cited by examiner

*Primary Examiner*—Jiping Lu
(74) *Attorney, Agent, or Firm*—Armstrong, Westerman, Hattori, McLeland & Naughton, LLP

(57) ABSTRACT

A drying apparatus has a hopper (1) for receiving an object to be dried, and an air supply unit (2) for supplying a high pressure air to the hopper (1). The air supply unit (2) includes a compressor (8), a dehumidifier (9), a heater (10), an air supply passage (11) which connects the compressor, the dehumidifier and the heater in series, and is connected to a supply port (3) of the hopper so as to supply a high pressure air to the hopper (1), and an ejector (12) arranged on the midway of the air supply passage. An injection port of the ejector is connected with an upstream side of the air supply passage, a discharge port of the ejector being connected with a downstream side of the air supply passage, an intake port of the ejector being connected to an exhaust port (4) of the dry apparatus main body via a return passage (31). Exhaust gas after dry treatment from the hopper is circulated and recycled between the hopper and the ejector, by a fluid energy of a high pressure dry air injected from the injection port of the ejector into the ejector.

15 Claims, 6 Drawing Sheets

(A)

DRYING APPARATUS USING HIGH PRESSURE GAS

BACKGROUND OF THE INVENTION

The present invention relates to a drying apparatus (equipment) for drying a powder particle such as plastic pellet, using high pressure gas, in particular, high pressure gas having a low humidity (low dew point).

Conventionally, a hopper dryer type drying apparatus has been widely known as a drying apparatus for drying a powder particle such as a plastic pellet. The drying equipment is arranged on an upper portion of an injection machine or extruder, and has a hopper receiving a plastic pellet, and a control unit which is arranged side the injection machine or extruder, and is connected with the hopper by an air supply passage and a return passage. The control unit includes a dehumidifier, a heater, a compressor, a circulating fan and the like, in its interior. Further, the control unit supplies a high pressure dry air to the hopper via the air supply passage while recovering exhaust gas after dry treatment from the hopper via the return passage, and then, dehumidifies and heats the recovered exhaust gas after dry treatment, and thereafter, again supplies the exhaust gas to the hopper via the air supply passage. In the aforesaid manner, in the drying apparatus, the exhaust gas after dry treatment is circulated, and then, is recycled, and thus, a pellet is dried. This type of control unit has been disclosed in Japanese Laid-Open Patent Publication No. Hei8-207044, for example.

By the way, a drying speed of the plastic pellet received in the hopper increases in proportion to an amount of drying air passing through the hopper. Therefore, in order to increase the drying speed of pellet, there is the need of supplying a large amount of drying air to the hopper. In order to achieve this, large-size and high performance compressor and circulating fan are required. In addition, this kind of conventional drying apparatus is constructed in the following manner; more specifically, the entire amount of exhaust gas after dry treatment from the hopper is returned back to the control unit, and then, is dehumidified in the control unit, and thereafter, is again circulated. For this reason, inevitably, the control unit must be made into a large size.

As a result, the drying apparatus is made into a large size as a whole; for this reason, there is a problem that an introduction (manufacture) cost and a running cost become high. Moreover, an installation space for the control unit must be secured; for this reason, a large-diameter air pipe (duct) is indispensable. As a result, there is a problem that a wide space is required around the injection machine or extruder, and also, a construction cost for installing the drying apparatus increases.

SUMMARY OF THE INVENTION

The present invention has been made taking the aforesaid problem in the prior art into consideration. It is, therefore, an object of the present invention to provide a drying apparatus using high pressure gas, which can perform the same dry treatment capacity as the case of using a large-size compressor with the use of a small-size compressor as compared with a conventional drying apparatus, and can economize a manufacture cost and a running cost spent for dry.

Further, another object of the present invention is to provide a drying apparatus which is constructed into a compact size as the entire apparatus, and can reduce a space spent for installation, and further, can achieve a reduction of cost spent for installation.

In order to achieve the above objects, the present invention provides a drying apparatus using high pressure gas, comprising: a drying apparatus main body including a supply port and an exhaust port, and receiving an object to be dried; and a gas supply unit for supplying high pressure dry gas to the drying apparatus main body, the gas supply unit including: a high pressure gas generating means for supplying pressurized gas; a dehumidifier for removing water content of gas; a heater for heating gas; a gas supply passage connecting the high pressure gas generating means, the dehumidifier and the heater while being connected to the supply port of the drying apparatus main body, and supplying controlled high pressure dry gas to the drying apparatus main body; and an ejector arranged on the way of the gas supply passage; an injection port of the ejector being connected with an upstream side of the gas supply passage, a discharge port of the ejector being connected with a downstream side of the gas supply passage, an intake port of the ejector being connected to the exhaust port of the dry apparatus main body via a return passage, exhaust gas after dry treatment from the drying apparatus main body being circulated and recycled between the drying apparatus main body and the ejector, by a fluid energy of the high pressure dry gas injected from the injection port of the ejector into the ejector.

According to the preferred embodiment, the high pressure gas generating means, the dehumidifier, the ejector and the heater are connected in series via the gas supply passage in succession from an upstream side.

According to another preferred embodiment, the drying apparatus main body is provided with a second exhaust port, and the second exhaust port is connected with an exhaust pipe for discharging extra exhaust gas after dry treatment from the drying apparatus main body to the outside.

According to another preferred embodiment, the drying apparatus further includes a branch gas supply passage which is diverged from a portion between the dehumidifier and the ejector in the gas supply passage, and the branch gas supply passage is connected to a second supply port formed in the drying apparatus main body.

According to another preferred embodiment, a second heater is arranged on the midway of the branch gas supply passage.

According to another preferred embodiment, the drying apparatus main body comprises a hopper, the first supply port is positioned above the second supply port, the gas supply passage and the branch gas supply passage are individually extended from the first and second supply ports into the hopper like a shape of inverted L-letter, and an outlet opening of the gas supply passage is positioned above an outlet opening of the branch gas supply passage.

According to another preferred embodiment, the ejector includes a suction housing which is formed with a suction chamber in its interior, and has the injection and intake ports and an outlet which communicate with the suction chamber; a diffuser connected to the outlet of the suction housing, and having the discharge port; and an injection pipe which is projected from the injection port into the suction chamber, and is extended toward the outlet of the suction housing.

According to another preferred embodiment, a filter is arranged on the midway of the return passage, and the filter contains an activated carbon as an absorbent.

According to another preferred embodiment, the gas comprises nitrogen gas.

In order to achieve the above objects, the present invention provides a drying apparatus using high pressure gas, comprising: a hopper including a supply port and an exhaust port, and receiving an object to be dried; and a gas supply unit for supplying high pressure dry gas to the drying apparatus main body, the gas supply unit including: a highpressure gas generating means for supplying pressurized gas; a dehumidifier for removing water content of gas; an ejector; a heater for heating gas; and a gas supply passage connecting the high pressure gas generating means, the dehumidifier, the ejector and the heater in series in succession from an upstream side while being connected to the supply port of the hopper, and extending from the supply port into the hopper like a shape of inverted L-letter, and further, supplying controlled high pressure dry gas to the hopper; an injection port of the ejector being connected with an upstream side of the gas supply passage, a discharge port of the ejector being connected with a downstream side of the gas supply passage, an intake port of the ejector being connected to the exhaust port of the hopper via a return passage, thereby exhaust gas after dry treatment from the hopper being circulated between the hopper and the ejector, by a fluid energy of the high pressure dry gas injected from the injection port of the ejector into the ejector, a portion on a downstream side from the heater in the gas supply passage having a double pipe structure comprising inner and outer cylindrical walls which are coaxially arranged, the inner cylindrical wall being formed with an inner passage in its inner space, an outer passage being formed in an annular space between the inner and outer cylindrical walls, heated high pressure dry gas from the heater being supplied to the outer passage, the inner passage being connected with a branch gas supply passage which is diverged from a portion between the dehumidifier and the ejector in the gas supply passage, and an outlet opening of the inner passage in the gas supply passage being positioned below an outlet opening of the outer passage.

According to another preferred embodiment, the double pipe structure is provided with a heat transfer fin which connects the inner cylindrical wall and the outer cylindrical wall, and extends to a lengthwise direction and a radius direction of the double pipe structure.

According to another preferred embodiment, the hopper is provided with a second exhaust port, and the second exhaust port is connected with an exhaust pipe for discharging extra exhaust gas after dry treatment from the hopper to the outside.

According to another preferred embodiment, the ejector includes a suction housing which is formed with a suction chamber in its interior, and has the injection and intake ports and an outlet which communicate with the suction chamber; a diffuser connected to the outlet of the suction housing, and having the discharge port; and an injection pipe which is projected from the injection port into the suction chamber, and is extended toward the outlet of the suction housing.

According to another preferred embodiment, a filter is arranged on the midway of the return passage, and the filter contains an activated carbon as an absorbent.

According to another preferred embodiment, the gas comprises nitrogen gas.

BRIEF DESCRIPTION OF THE DRAWINGS

FIG. 5(A) is a view schematically showing a construction of a drying apparatus according to still another embodiment of the present invention.

DETAILED DESCRIPTION OF THE PREFERRED EMBODIMENTS

Figure 1:
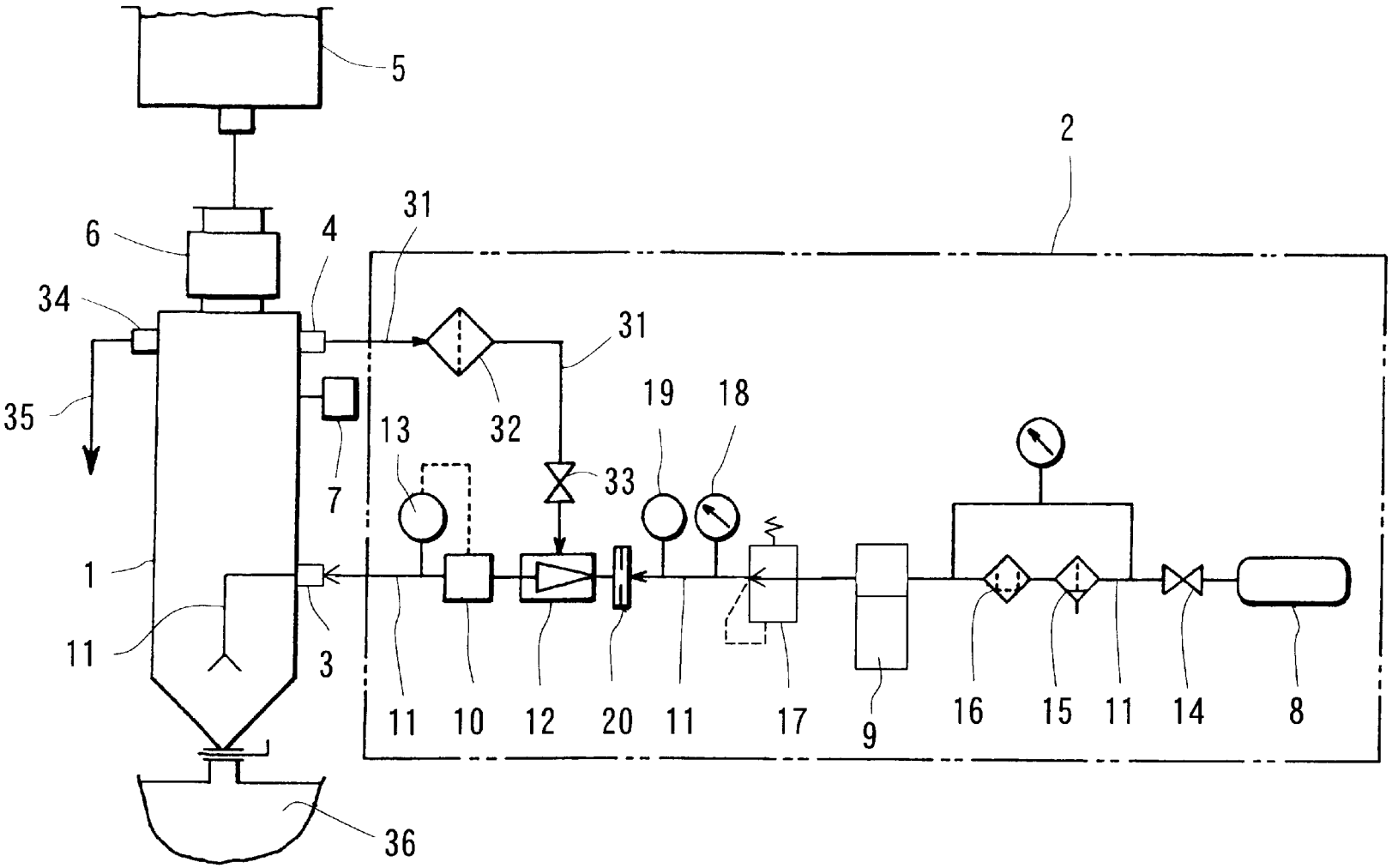
FIG. 1 is a view schematically showing a construction of a drying apparatus according to one embodiment of the present invention.

FIG. 1 is a view schematically showing a construction of a drying apparatus according to one embodiment of the present invention. In this embodiment, a drying apparatus according to the present invention is constructed as a hopper dryer type drying apparatus. As shown in FIG. 1, the drying apparatus of the present invention is provided with a supply port 3 and an exhaust port 4 at its upper and lower portions, respectively. Further, the drying apparatus has a hopper (drying apparatus main body) 1 for receiving an object to be dried (plastic pellet in this embodiment), and an air supply unit 2 for supplying a high pressure dry air to the hopper 1.

The hopper 1 is provided with a material charger 6 at its upper portion. The material charger 6 receives a plastic pellet supplied from a material tank 5, and supplies a proper amount of plastic pellet to the hopper 1 in accordance with a variation of charge level of the plastic pellet stored in the hopper. Further, the hopper 1 is provided with a level sensor 7 for detecting a charge level of pellet stored in the hopper 1, at its inner peripheral surface on the upper portion thereof. The material charger 6 controls a feed of pellet from the material tank 5 on the basis of a detection result of the level sensor 7 so as to keep constant the charge level of pellet stored in the hopper 1. In FIG. 1, the reference numeral 36 denotes a screw cylinder of an injection machine.

The air supply unit 2 has a compressor 8 (in this embodiment, air compressor) as a high pressure gas generating means for supplying pressurized (compressed) gas, a dehumidifier 9 for removing a water content, a heater 10 for heating gas, and an air supply passage 11 connected to the supply port 3 of the hopper 1. The above compressor 8, dehumidifier 9 and heater 10 are connected in series in succession from an upstream side. The air supply passage is extended like a shape of inverted L-letter from the supply port 3 into the hopper 1. The high pressure gas generating means is not limited to the compressor 8, and for example, a nitrogen gas cylinder may be employed as the high pressure gas generating means when nitrogen gas is used as the drying gas.

Further, in the air supply unit 2, an ejector 12 is arranged on the midway of the air supply passage 11 between the dehumidifier 9 and the heater 10. A downstream side air supply passage 11 of the heater 10 is provided with a temperature sensor 13 for controlling a heating state of the heater 10. As described above, the compressor 8, the dehumidifier 9, the ejector 12 and the heater 10 are arranged in series in succession from the upstream side, and thereby, it is possible to securely carry out a temperature control of the high pressure dry air supplied to the hopper 1.

Furthermore, in the air supply unit 2, a valve 14, a drain separator 15 and a micro-mist separator 16 are arranged in succession from the upstream side in the air supply passage 11 between the compressor 8 and the dehumidifier 9.

The dehumidifier 9 removes a water content contained in a pressurized air supplied from the compressor 8 so as to generate a pressurized dry air having a humidity having a predetermined value or less. The following various dehumidifiers acquirable on the market are usable as the dehumidifier 9; more specifically, there are a dehumidifier including a hollow fiber module as a dehumidifying element, a dehumidifier including an absorbent as a dehumidifying element, or the like.

In the air supply passage between the dehumidifier 9 and the ejector 12, a pressure regulator 17, a pressure gauge 18, a pressure switch 19 and a dehumidifying orifice 20 are arranged in succession from the upstream side. The dehumidifying orifice 20 keeps constant the gas flow rate of the air supply passage 11, and functions so as to stabilize a dehumidifying effect of the dehumidifier 9 in cooperation with the pressure regulator 17. When the valve 14 arranged just the downstream side of the compressor 8 in the air supply passage 11 is opened, the pressure switch 19 is changed over from an off state to an on state so as to electrically energize the heater 10. Then, when the gas pressure of the air supply passage 11 lowers, the pressure switch 19 is changed over from an on state to an off state so as to stop an electric energization to the heater 10.

Figure 2:
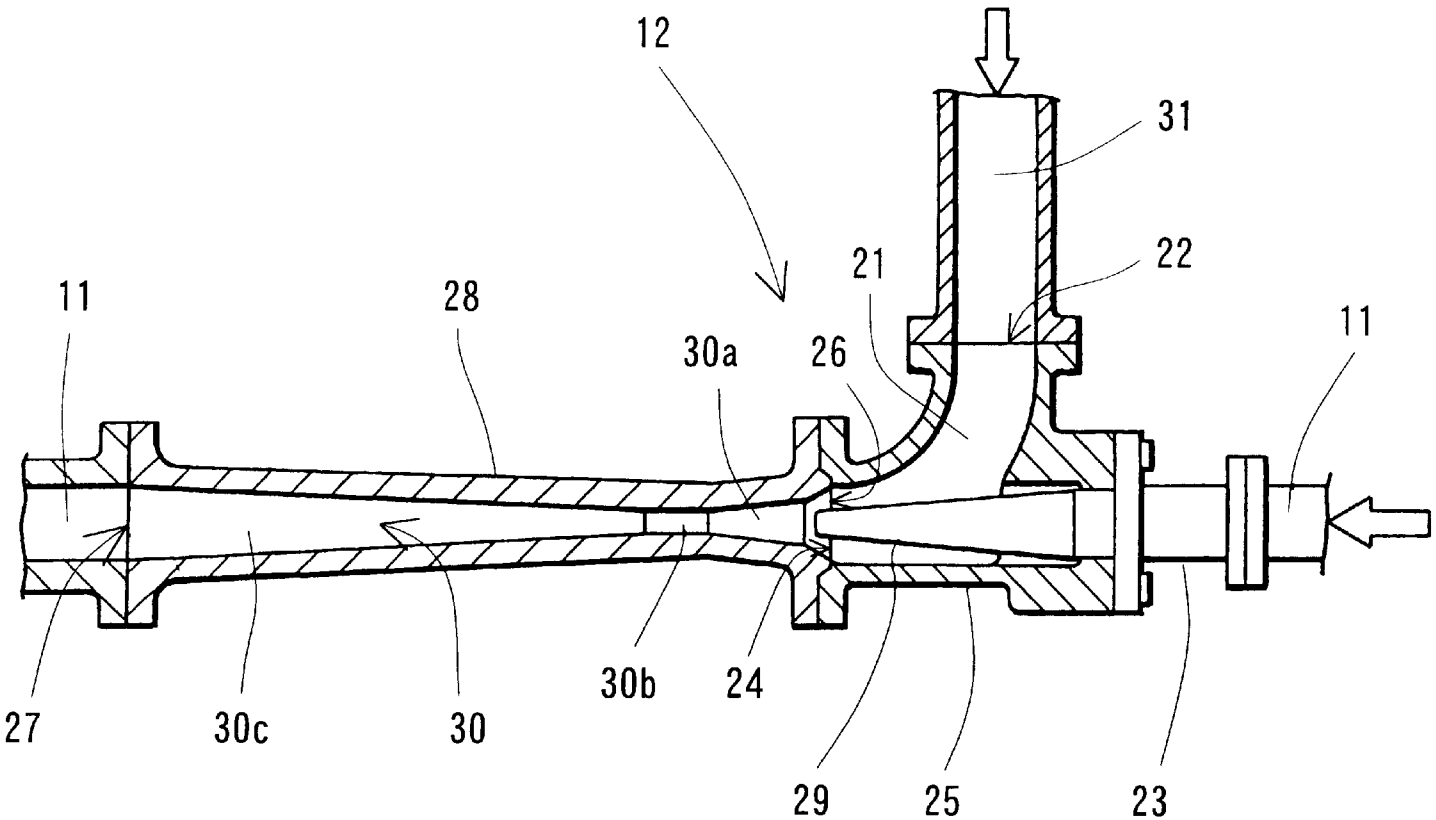
FIG. 2 is a cross sectional view schematically showing an ejector of the drying apparatus shown in FIG. 1.

FIG. 2 is a cross sectional view schematically showing an ejector of the drying apparatus shown in FIG. 1. As shown in FIG. 2, the ejector 12 includes: a suction housing 25 having a suction chamber 21 formed in its interior, an injection port 23, an intake port 22 and an outlet 24 which communicate with the suction chamber 21, and a diffuser 28 having a inflow port 26 at one end thereof and a discharge port 27 at the other end thereof. The diffuser 28 is connected to the outlet 24 of the suction housing 25 at its inflow port 26. The ejector 12 further includes an injection pipe 29 which is projected from the injection port 23, and is extended toward the outlet 24 of the suction housing 25.

As seen from FIG. 2, the diffuser 28 is formed with a gas passage 30 along an axial direction. The gas passage 30 comprises a small-diameter passage portion 30*a*, an accelerating passage portion 30*b* and a large-diameter passage portion 30*c*. More specifically, the small-diameter passage portion 30*a* is gradually tapered from the inflow port 26 of the diffuser 28, the accelerating passage portion 30*b* is continuously connected to the passage portion 30*a* and has a substantially fixed diameter, and the large-diameter passage portion 30*c* is continuously connected to the passage portion 30*b* and becomes gradually large toward the discharge port 27 of the diffuser 28. The injection pipe 29 is arranged so that its distal end portion is directed to the accelerating passage portion 30*b*.

Referring now to FIG. 1 and FIG. 2, the injection port 23 of the ejector 12 is connected with the upstream side of the air supply passage 11, that is, the orifice 20 side; on the other hand, the discharge port 27 of the ejector 12 is connected with the downstream side of the air supply passage 11, that is, the heater 10 side. Further, the intake port 22 of the ejector 12 is connected to the exhaust port 4 of the hopper 1 via a return passage 31. The return passage 31 is provided with a filter 32 and a flow control vale 33.

In this case, the ejector is not limited to that of this embodiment, and therefore, according to the present invention, every other ejector having an injection port, an intake port and a discharge port may be employed.

The filter 32 has a function of absorbing oligomer, various plasticizers, fats and oils, dust or the like, in view of the following factor. More specifically, in the case of carrying out a dry treatment in the hopper 1, oligomer, various plasticizers, fats and oils volatilized from pellet and dust adhere to a dried pellet as a contamination, and thereafter, this is a factor of molding defective. In this case, it is preferable that the filter 32 contains an activated carbon (charcoal) as an absorbent.

In the above manner, when a new controlled high pressure dry air supplied from the injection port 23 of the ejector 12 is injected from the injection pipe 29 into the suction chamber 21, an internal pressure of the suction chamber 21 is reduced. Whereby, the exhaust gas after dry treatment from the hopper 1 is sucked into the suction chamber 21 from the intake port 22 of the ejector 12, and then, is mixed with the new controlled high pressure dry gas, and subsequently, is pressurized passing through the diffuser 28, and then, is discharged from the discharge port 27 of the ejector 12 to the heater 10 side. By doing so, the exhaust gas after dry treatment from the hopper 1 is forcedly circulated in a manner of passing through the return passage 31, the ejector 12 and passing through the air supply passage 11 connected to the supply port 3 of the hopper 1 via the heater 10 from the ejector 12.

The hopper 1 is provided with a second exhaust port 34. The second exhaust port 34 is connected with an exhaust pipe 35 for discharging extra exhaust gas after dry treatment from the hopper 1 to the outside.

In the drying apparatus of the present invention, exhaust gas contacts with a plastic pellet in the hopper, and then, is subjected to a dry treatment. The exhaust gas is repeatedly circulated so as to dry the plastic pellet. Therefore, it is possible to reduce a consumption of high pressure dry gas newly controlled in drying the pellet. More specifically, the flow rate of exhaust gas after dry treatment circulating through the return passage 31 is several times as much as a flow rate new high pressure dry gas injected from the injection pipe 29 in the ejector 12. Thus, a large amount of high pressure dry gas is supplied to the hopper 1; nevertheless, a consumption of new controlled high pressure dry gas is remarkably reduced. Moreover, the new controlled high pressure dry gas is continuously refilled with the exhaust gas after dry treatment, and further, a part of the exhaust gas after dry treatment is discharged to the outside of the hopper 1 passing through the discharge duct passage 35. Therefore, the exhaust gas after dry treatment is repeatedly circulated and recycled; nevertheless, a humidity of the exhaust gas is always kept to a constant value or less.

Figure 3:
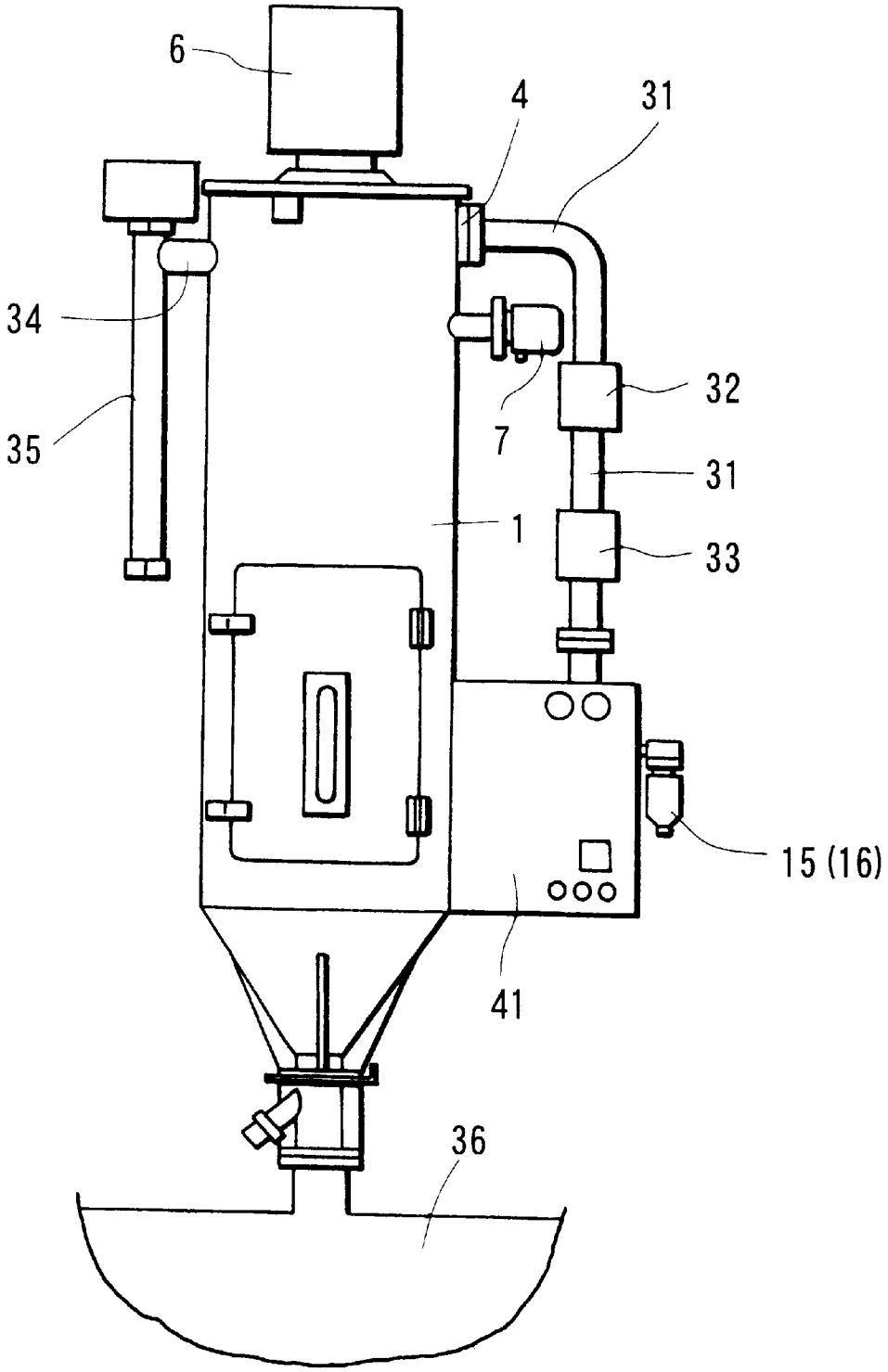
FIG. 3 is a front view of the drying apparatus shown in FIG. 1.

In the manner as described above, the exhaust gas after dry treatment from the hopper 1 is repeatedly circulated and dried, and thereby, it is possible to reduce a consumption of new controlled high pressure dry gas. Therefore, this serves to make small equipments such as compressor 8, dehumidifier 9 and heater 10 constituting the air supply unit 2. As a result, as shown in FIG. 3, the dehumidifier 9, the ejector 12 and the heater 10 are arranged in a state of being collectively received in a housing 41 attached to an outer wall surface of the hopper 1, and thereby, it is possible to provide the air supply unit 2 integrally with the hopper 1; therefore, a space for attaching the air supply unit can be remarkably reduced.

By using the ejector requiring no power source, the new controlled high pressure dry air is uniformly mixed with the exhaust gas after dry treatment; therefore, it is possible to simultaneously perform a circulating effect of exhaust gas and a mixing effect of the exhaust gas with new dry air by only fluid energy of dry air. As a result, the structure of the air supply unit 2 can be simplified. Further, no complicate control unit is required, so that a maintenance of the drying apparatus can be readily performed.

In the drying apparatus of the present invention, usually, a dry air is used as dry gas. In place of air, nitrogen gas and gases other than this may be used depending upon a characteristic of pellet to be dried. In the case where the nitrogen gas is used as a dry air, it is possible to prevent an oxidation when drying a nylon resin pellet.

The following are actually measured values in the case of using the aforesaid drying apparatus, and drying polyethylene terephthalate.

Figure 4:
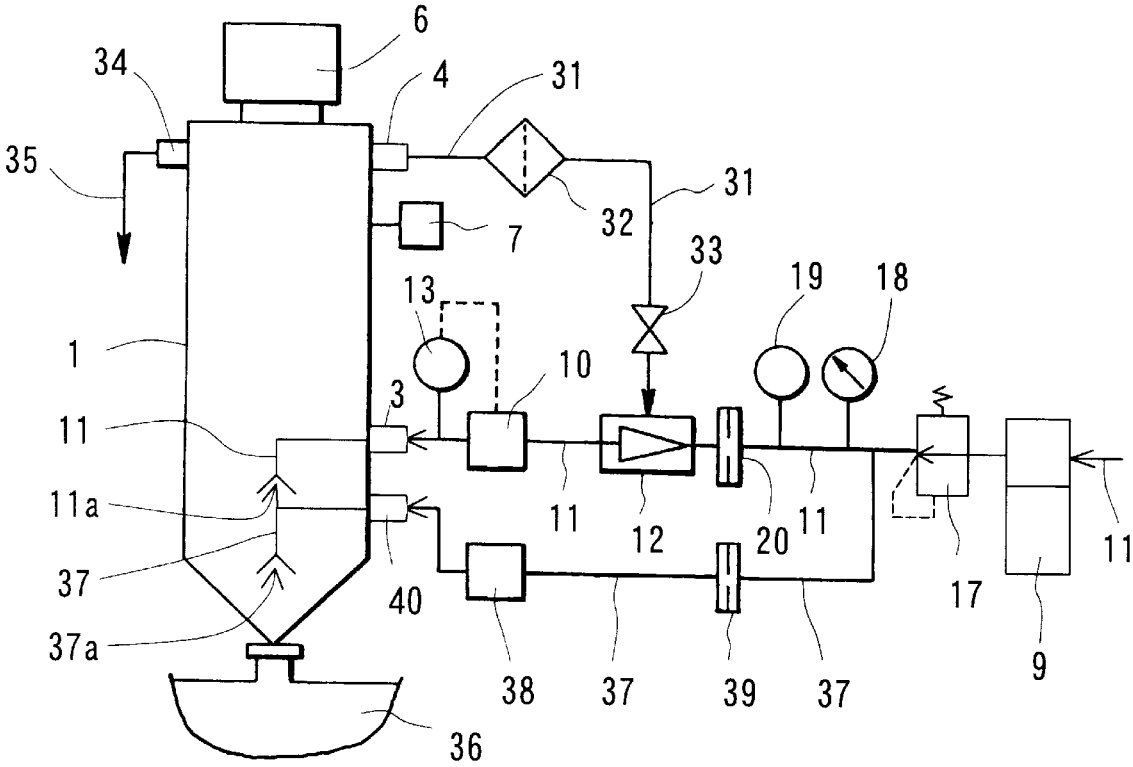
FIG. 4 is a view schematically showing a construction of a drying apparatus according to another embodiment of the present invention.

Row material plastic water content/rate: 2000 ppm/0.2%
Plastic water content after dry: 100 ppm
Dew point of dry air after dehumidified (conversion into atmospheric pressure): −40° C.
Dew point of dry air in hopper inlet (conversion into atmospheric pressure): −20° C.
Dew point of dry exhaust gas (conversion into atmospheric pressure): −12° C.
Temperature of dry air in hopper inlet: 160° C.
Consumption of dry air: 34 $m^3$/h
Circulating air in hopper: 60 $m^3$/h
Circulating air of dry exhaust: 34 $m^3$/h
Dry treatment amount (in the case where hopper capacity is 60 kg): 20 kg/h FIG. 4 is a view schematically showing a construction of a drying apparatus according to another embodiment of the present invention. This embodiment shown in FIG. 4 is different from the above embodiment shown in FIG. 1 in a construction of air supply passage on the downstream side from the dehumidifier 9. Therefore, like reference numerals are used to designate the same components as those shown in FIG. 1, and the details are omitted.

As shown in FIG. 4, in the air supply passage 11, a branch air supply passage 37 is diverged from a portion between the dehumidifier 9 and the ejector 12, in particular, from a portion between the pressure regulator 17 and the pressure gauge 18. The branch air supply passage 37 is connected to a second supply port 40 formed in the hopper 1.

In the branch air supply passage 37, a second orifice 39 and a second heater 38 for temperature control as the necessity arises, are arranged in succession from the upstream side.

Moreover, the first supply port 3 of the hopper 1 is positioned above the second supply port 40, and the air supply passage 11 and the branch air supply passage 37 are extended from the first and second supply ports 3 and 40 into the hopper 1 like a shape of inverted L-letter, respectively. An outlet opening 11*a* of the air supply passage 11 is positioned above an outlet opening 37*a* of the branch air supply passage 37.

According to the embodiment shown in FIG. 4, the exhaust gas after dry treatment from the hopper 1 is mixed with new controlled high pressure gas, and then, passes through the air supply passage 11, and thereafter, is supplied from the upper side first supply port 3 into the hopper 1. Simultaneously, only high pressure dry air new controlled passes through the branch air supply passage 37, and then, is supplied from the lower side second supply port 40 into the hopper 1.

As described above, according to this embodiment, as compared with the case of the above embodiment shown in FIG. 1, dry gas having a lower humidity (low dew point) is supplied into the hopper 1. Therefore, the embodiment shown in FIG. 4 is specially effective in a dry treatment of pellet such as a PET resin pellet requiring a final water content after a low dry treatment of 50 ppm or less.

FIG. 5(A) is a view schematically showing a construction of a drying apparatus according to still another embodiment of the present invention. This embodiment shown in FIG. 5(A) is different from the above embodiment shown in FIG. 1 in a construction of the air supply passage on the downstream side. Therefore, like reference numerals are used to designate the same components as those shown in FIG. 1, and the details are omitted.

As shown in FIG. 5(A), the air supply passage 11 on the downstream side from the heater 10 has a double pipe structure 42 comprising an inner cylindrical wall 43 and an outer cylindrical wall 44 which are coaxially arranged. As seen from FIG. 5(A) and FIG. 5(B), the inner cylindrical wall 43 is formed with an inner passage 45 in its inner space, and is formed with an outer passage 46 in an annular space between inner and outer cylindrical walls 43 and 44.

Heated pressure dry gas from the heater 10 is supplied to the outer passage 46, and the inner passage 45 is connected with a branch air supply passage 47 which is diverged from a portion between the dehumidifier 9 and the ejector 12, in particular, from a portion between the pressure regulator 17 and the pressure gauge 18 in the air supply passage 11. In the branch air supply passage, a dehumidifying orifice 49 is arranged. Moreover, an outlet opening 45*a* of the inner passage 45 of the air supply passage 42 is arranged above an outlet opening 46*a* of the outer passage 46.

In addition, as seen from FIG. 5(B), the double pipe structure 42 is provided with a heat transfer fin 48 which connects the inner and outer cylindrical walls 43 and 44, and extends to a lengthwise and radius directions of the double pipe structure 42.

Figure 5:
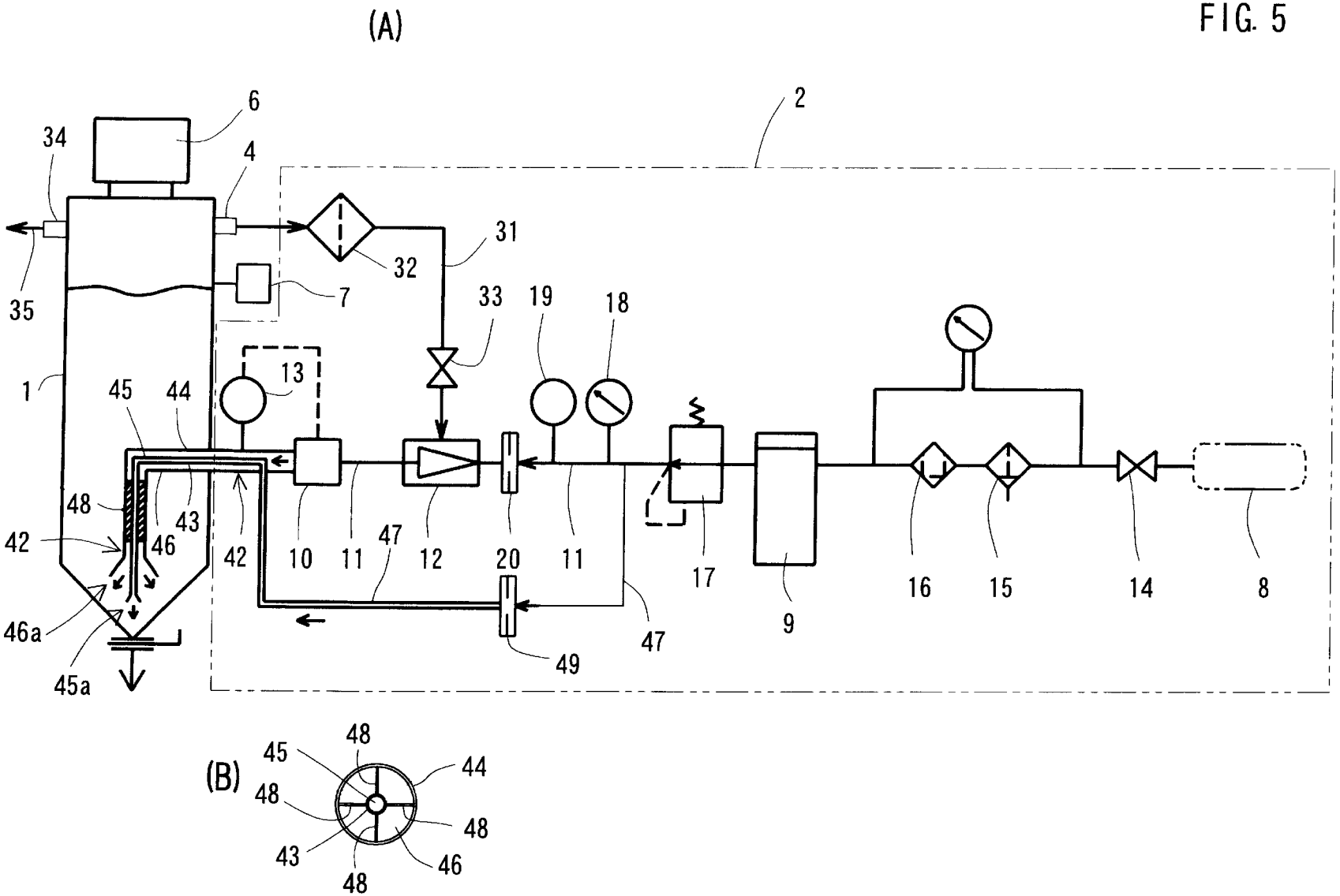
FIG. 5 (B) is a traverse sectional view showing a double pipe structure of FIG. 5(A)

In this embodiment shown in FIG. 5, the exhaust gas after dry treatment is mixed with the new controlled high pressure dry gas, and then, passes through the outer passage 46 of the double pipe structure 42, and thus, is supplied from the upper side outlet opening 46*a* into the hopper 1. Simultaneously, only high pressure dry air new controlled passes through the branch air supply passage 47 and the inner passage 45 of the double pipe structure 42, and then, is supplied from the lower side outlet opening 45*a* into the hopper 1. In this case, the new controlled high pressure dry air flowing through the inner passage 45 is heated by a heat transfer from a high temperature mixed dry air which flows through the outer passage 46 and is heated by the heater 10. The heat transfer fin 48 functions so as to facilitate the above heat transfer.

According to this embodiment, it is possible to obtain the same effect as the above embodiment shown in FIG. 4.

Figure 6:
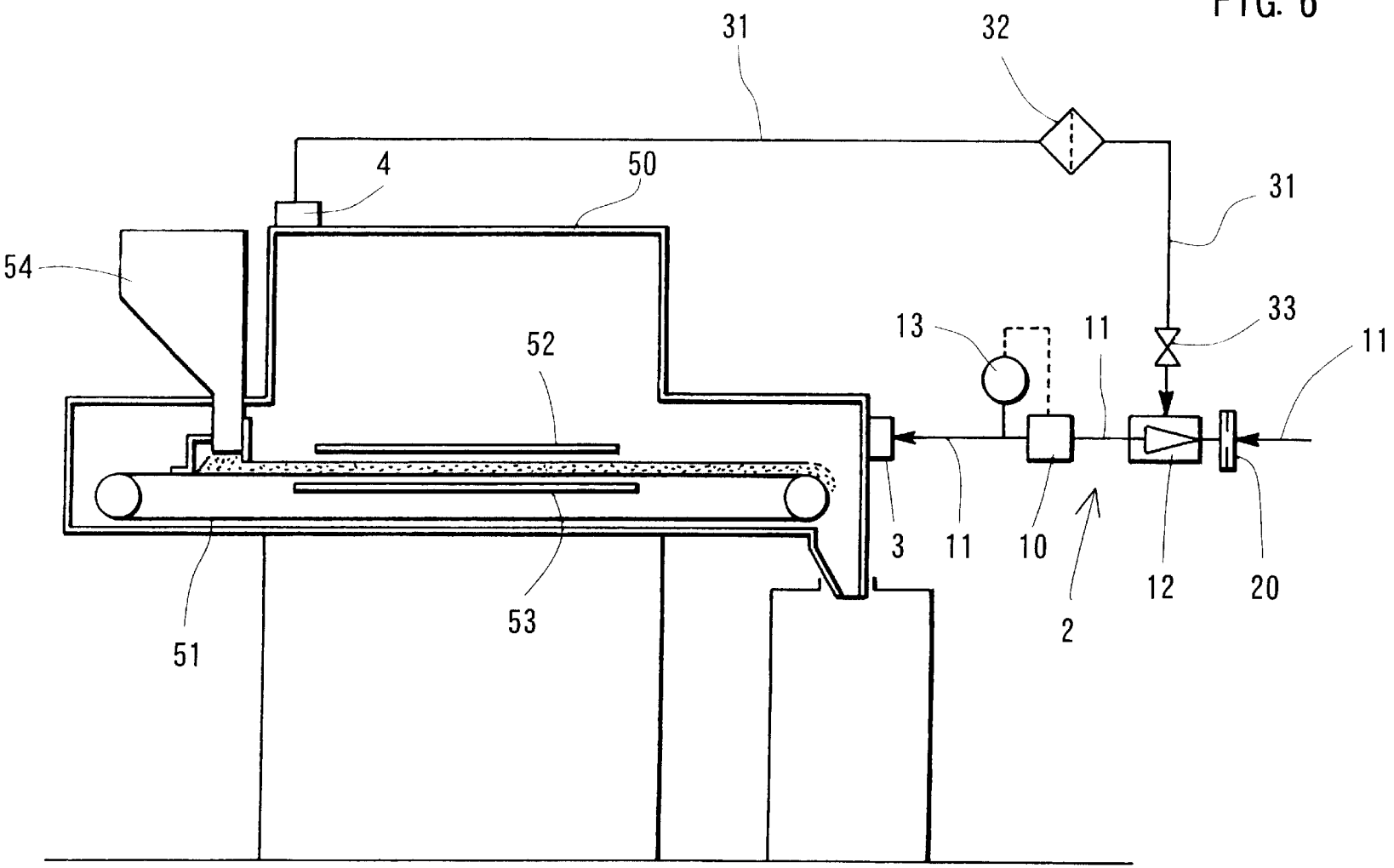
FIG. 6 is a view schematically showing a construction of a drying apparatus according to still another embodiment of the present invention.

FIG. 6 is a view schematically showing a construction of a drying apparatus according to still another embodiment of the present invention. In this embodiment, the drying apparatus is constructed as a conveyer type drying apparatus.

As shown in FIG. 6, the conveyer type drying apparatus has a belt conveyer 51 for transfers a plastic pellet at a constant speed in a sealed dry tank 50. A high frequency voltage is applied between electrode plates 52 and 53 arranged on each of upper and lower surfaces of the belt conveyer 51, and thus, the plastic pellet is heated from its interior. In order to remove a moisture in the dry tank 50 and to facilitate a dry of the plastic pellet, the air supply unit 2 of the present invention is arranged, and the discharge port of the ejector 12 and the supply port of the dry tank 50 are connected by the air supply passage 11, and further, the exhaust port 4 of the dry tank 50 and the intake port of the ejector 12 are connected by the return passage 31. A reference numeral 54 denotes a hopper for charging materials. Also, like reference numerals are used to designate the same components as the above embodiment shown in FIG. 1, and the details are omitted.

What is claimed is:

1. A drying apparatus using high pressure gas, comprising:

a drying apparatus main body including a supply port and an exhaust port, and receiving an object to be dried; and a gas supply unit for supplying high pressure dry gas to the drying apparatus main body, said gas supply unit including:

a high pressure gas generating means for supplying pressurized gas;

a dehumidifier for removing water content of gas;

a heater for heating gas;

a gas supply passage connecting said high pressure gas generating means, said dehumidifier and said heater while being connected to said supply port of said drying apparatus main body, and supplying controlled high pressure dry gas to said drying apparatus main body; and an ejector arranged on the way of said gas supply passage, an injection port of said ejector being connected with an upstream side of said gas supply passage, a discharge port of said ejector being connected with a downstream side of said gas supply passage, an intake port of said ejector being connected to said exhaust port of said dry apparatus main body via a return passage, exhaust gas after dry treatment from said drying apparatus main body being circulated and recycled between said drying apparatus main body and said ejector, by a fluid energy of the high pressure dry gas injected from said injection port of said ejector into said ejector.

2. The drying apparatus using high pressure gas according to claim 1, wherein said high pressure gas generating means, said dehumidifier, said ejector and said heater are connected in series via said gas supply passage in succession from an upstream side.

3. The drying apparatus using high pressure gas according to claim 1, wherein said drying apparatus main body is provided with a second exhaust port, and said second exhaust port is connected with an exhaust pipe for discharging extra exhaust gas after dry treatment from said drying apparatus main body to the outside.

4. The drying apparatus using high pressure gas according to claim 3, wherein further includes a branch gas supply passage which is diverged from a portion between said dehumidifier and said ejector in said gas supply passage, and said branch gas supply passage is connected to a second supply port formed in said drying apparatus main body.

5. The drying apparatus using high pressure gas according to claim 4, wherein a second heater is arranged on the midway of said branch gas supply passage.

6. The drying apparatus using high pressure gas according to claim 4, wherein said drying apparatus main body comprises a hopper, said first supply port is positioned above said second supply port, said gas supply passage and said branch gas supply passage are individually extended from said first and second supply ports into said hopper like a shape of inverted L-letter, and an outlet opening of said gas supply passage is positioned above an outlet opening of said branch gas supply passage.

7. The drying apparatus using high pressure gas according to claim 1, wherein said ejector including:

a suction housing which is formed with a suction chamber in its interior, and has said injection and intake ports and an outlet which communicate with said suction chamber;

a diffuser connected to said outlet of said suction housing, and having said discharge port; and an injection pipe which is projected from said injection port into said suction chamber, and is extended toward said outlet of said suction housing.

8. The drying apparatus using high pressure gas according to claim 1, wherein a filter is arranged on the midway of said return passage, and said filter contains an activated carbon as an absorbent.

9. The drying apparatus using high pressure gas according to any of claims 1 to 8, wherein said gas comprises nitrogen gas.

10. A drying apparatus using high pressure gas, comprising:

a hopper including a supply port and an exhaust port, and receiving an object to be dried; and a gas supply unit for supplying high pressure dry gas to said hopper, said gas supply unit including:

a high pressure gas generating means for supplying pressurized gas;

a dehumidifier for removing water content of gas;

an ejector;

a heater for heating gas; and a gas supply passage connecting said high pressure gas generating means, said dehumidifier, said ejector and said heater in series in succession from an upstream side while being connected to said supply port of said hopper, and extending from said supply port into said hopper like a shape of inverted L-letter, and further, supplying controlled high pressure dry gas to said hopper;

an injection port of said ejector being connected with an upstream side of said gas supply passage, a discharge port of said ejector being connected with a downstream side of said gas supply passage, an intake port of said ejector being connected to said exhaust port of said hopper via a return passage, thereby exhaust gas after dry treatment from said hopper being circulated between said hopper and said ejector, by a fluid energy of the high pressure dry gas injected from said injection port into said ejector, a portion on a downstream side from said heater in said gas supply passage having a double pipe structure comprising inner and outer cylindrical walls which are coaxially arranged, said inner cylindrical wall being formed with an inner passage in its inner space, an outer passage being formed in an annular space between said inner and outer cylindrical walls, heated high pressure dry gas from said heater being supplied to said outer passage, said inner passage being connected with a branch gas supply passage which is diverged from a portion between said dehumidifier and said ejector in said gas supply passage, and an outlet opening of said inner passage in said gas supply passage being positioned below an outlet opening of said outer passage.

11. The drying apparatus using high pressure gas according to claim 10, wherein the double pipe structure is provided with a heat transfer fin which connects the inner cylindrical wall and the outer cylindrical wall, and extends to a lengthwise direction and a radius direction of the double pipe structure.

12. The drying apparatus using high pressure gas according to claim 10, wherein said hopper is provided with a second exhaust port, and said second exhaust port is connected with an exhaust pipe for discharging extra exhaust gas after dry treatment from said hopper to the outside.

13. The drying apparatus using high pressure gas according to claim 10, wherein said ejector including:

a suction housing which is formed with a suction chamber in its interior, and has said injection and intake ports and an outlet which communicate with said suction chamber;

a diffuser connected to said outlet of said suction housing, and having said discharge port; and an injection pipe which is projected from said injection port into said suction chamber, and is extended toward said outlet of said suction housing.

14. The drying apparatus using high pressure gas according to claim 10, wherein a filter is arranged on the midway of said return passage, and said filter contains an activated carbon as an absorbent.

15. The drying apparatus using high pressure gas according to any of claims 10 to 14, wherein said gas comprises nitrogen gas.

* * * * *